US006223762B1

(12) United States Patent
Ghaeli et al.

(10) Patent No.: US 6,223,762 B1
(45) Date of Patent: May 1, 2001

(54) DEVICE AND METHOD FOR SUPERODORIZING AN LP-GAS TANK

(76) Inventors: Hooshang R. Ghaeli, 100 Michael La., Ponca City, OK (US) 74604; Kevin L. Copple, Box 727, Blackwell, OK (US) 74631

( * ) Notice: Subject to any disclaimer, the term of this patent is extended or adjusted under 35 U.S.C. 154(b) by 0 days.

(21) Appl. No.: 09/560,769

(22) Filed: Apr. 28, 2000

(51) Int. Cl.[7] ..... F16K 17/16

(52) U.S. Cl. ..... 137/68.22; 137/68.19; 137/68.23; 137/205.5; 141/9; 141/100; 48/195

(58) Field of Search ..... 137/68.19, 68.22, 137/68.23, 68.27, 205.5; 48/195; 141/2–5, 9, 18, 21, 100, 105, 107

(56) References Cited

U.S. PATENT DOCUMENTS 2,780,071 * 2/1957 Calva ..... 137/268
3,907,515 * 9/1975 Mulliner ..... 48/195
4,007,755 * 2/1977 Lerner et al. .
4,504,281 * 3/1985 Williams, Jr. et al. .
4,701,303 * 10/1987 Nevers .
5,406,970 * 4/1995 Marshall et al. .
5,632,295 * 5/1997 Smars .
5,746,973 * 5/1998 Naraghi .
5,839,285 * 11/1998 Kniebes .
5,878,772 * 3/1999 Belyea .
5,885,701 * 3/1999 Berman et al. .

* cited by examiner

*Primary Examiner*—John Rivell
*Assistant Examiner*—Ramesh Krishnamurthy
(74) *Attorney, Agent, or Firm*—Randal D. Homburg

(57) ABSTRACT

The invention is a device and method for superodorizing an LP-gas tank with a mercaptan odorant for a new LP-gas tank and other situations requiring additional odorant, thus giving the new or older LP-gas tank and its contents the "skunk scent" required for proper leakage detection of the otherwise colorless, odorless LP-gas.

10 Claims, 3 Drawing Sheets

DEVICE AND METHOD FOR SUPERODORIZING AN LP-GAS TANK

CROSS REFERENCE TO RELATED APPLICATIONS

None.

I. BACKGROUND OF INVENTION

1. Field of the Invention

The invention is a device and method for superodorizing an LP-gas tank with a mercaptan odorant for a new LP-gas tank and other situations requiring additional odorant, thus giving the new or older LP-gas tank and its contents the "skunk scent" required for proper leakage detection of the otherwise colorless, odorless LP-gas.

2. Description of the Prior Art

The following United States patents are disclosed herein and incorporated into this application for utility patent. All relate to injection devices, including those for the injection of odorants. U.S. Pat. No. 4,007,755 to Lerner, et al., discloses an electronic component injection system injecting a predetermined amount of additive fluid into a main stream of fluid and continually circulating the additive within the flow of the main stream fluid. A closed and environmentally safe odorant injection apparatus comprising a pressurized gas supply, an odorant storage tank and a panel containing a level pot and sight tank and manually actuated pneumatically operated switches for drawing a measured portion of odorant and injecting it into a tank truck being loaded with LP-gas is disclosed in U.S. Pat. No. 4,504,281 to Williams, et al. A process for pre-treating containers having new or recently cleaned interior surfaces using a mixture of chemicals coating such interior is disclosed in U.S. Pat. No. 4,701,303 to Nevers. A chemical injection system having a programable controller is disclosed in U.S. Pat. No. 5,406, 970 to Marshall, et al., such device disclosing a use with odorant injection and also having a monitoring device for measuring the amount of odorant injected.

Another electronic device and method for adding a mal odorant to a consumer gas and monitoring the precision amount of gas to odorant ratio is disclosed in U.S. Pat. No. 5,632,295 to Smars. A chemical method of reducing odorant depletion using a passivating agent containing a phosphate ester is disclosed in U.S. Pat. No. 5,746,973 to Naraghi. A fuel gas delivery system comprising a liquid fuel tank and a connected second tank or second compartment within the fuel tank, such second tank filled with vaporized fuel by small diameter tubing, thus reducing concentration changes to the odorant is disclosed in U.S. Pat. No. 5,839,285 to Kniebes. In U.S. Pat. No. 5,885,701 to Berman, et al., an odorant delivery system for perfumes in a sealed package with a layer of non-permeable material over the odorant for introducing perfume samples within a magazine or booklet is disclosed. In U.S. Pat. No. 5,878,772 to Belyea, a dye injection system on a fuel delivery truck is disclosed.

II. SUMMARY OF THE INVENTION

The primary objective of the invention is to provide a simple device for in-line attachment between a fuel delivery system and a fuel tank, providing a measured amount of a mercaptan odorant within the device, contained between two containment disks, which rupture without fragmentation by the force of the LP-gas fuel being delivered from the fuel delivery system into the tank. A second objective of the invention is to provide a device for pre-odorizing or re-odorizing an LP-gas fuel tank, especially those being constructed of steel or those having the inner vessel exposed to air or water and those being installed using steel pipe to reduce the risk of "odor fade" which is a common risk in the LP-gas industry.

A third objective is to provide a simple low-cost device for delivery of the odorant to the inside of the LP-gas tank which does not require additional equipment or modification of existing equipment which is attached in-line with the filling hose, the odorant delivered to the inner tank at the time of initial filling or later refilling of the tank. A fourth objective is to disclose the method for odorizing LP gas tanks using the disclosed device.

III. DESCRIPTION OF THE DRAWINGS

The following drawings are submitted with this utility patent application.

IV. DESCRIPTION OF THE PREFERRED EMBODIMENT

Figure 1:
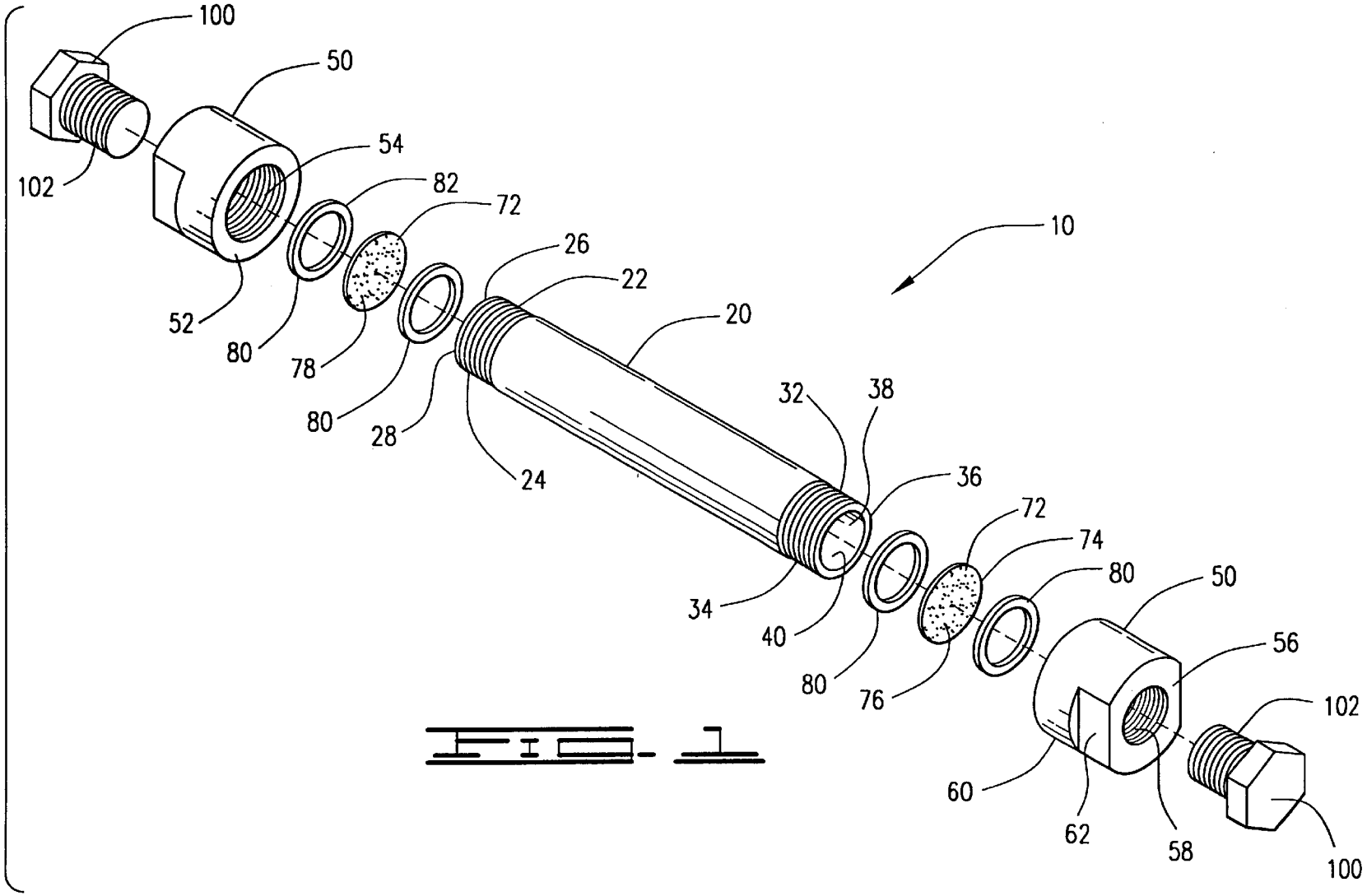
FIG. 1 is an exploded view of the device for superodorizing an LP gas tank.
Figure 2:
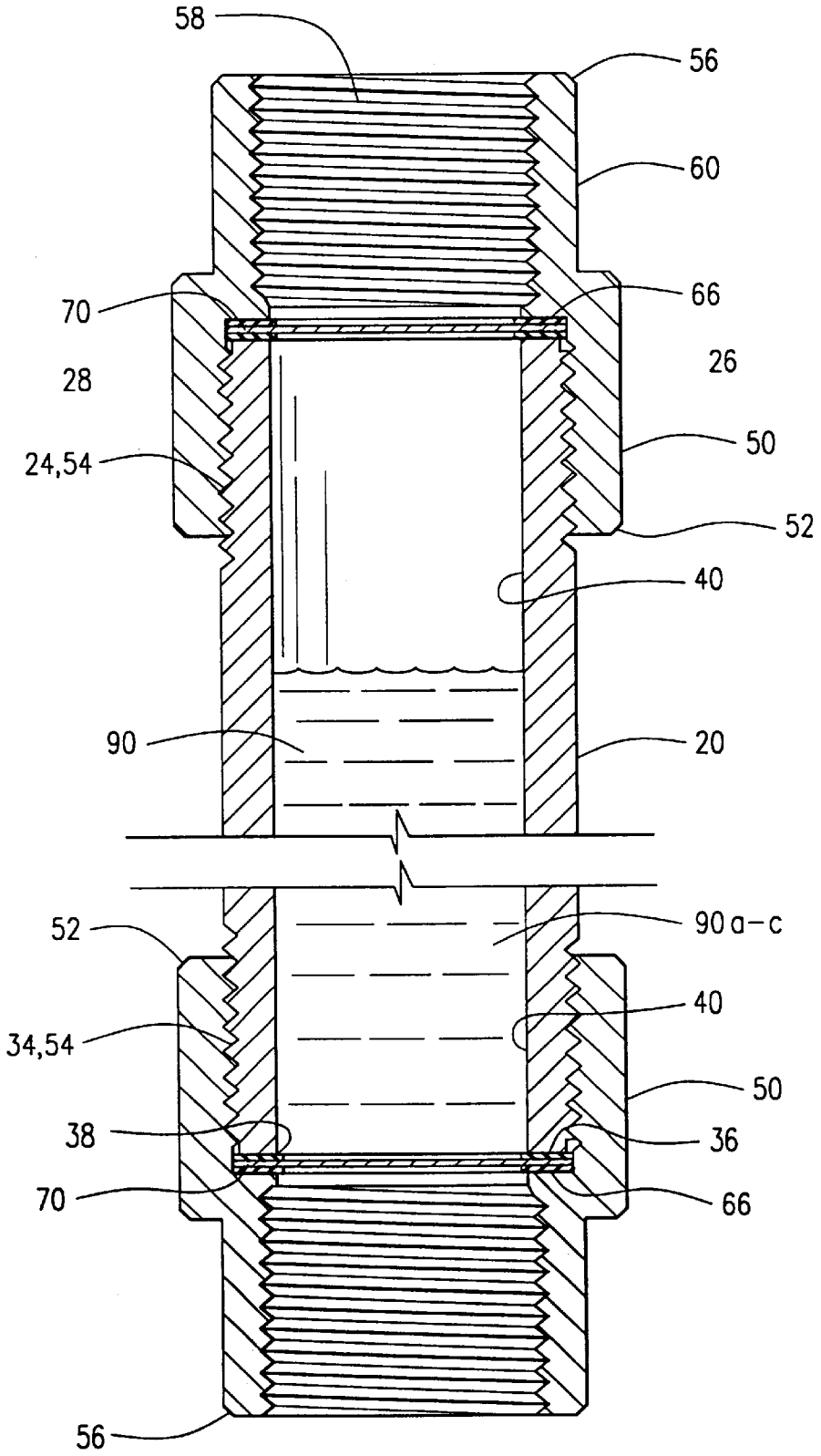
FIG. 2 is a cross sectional view of the intact containment disc in an end of the delivery tube.
Figure 3:
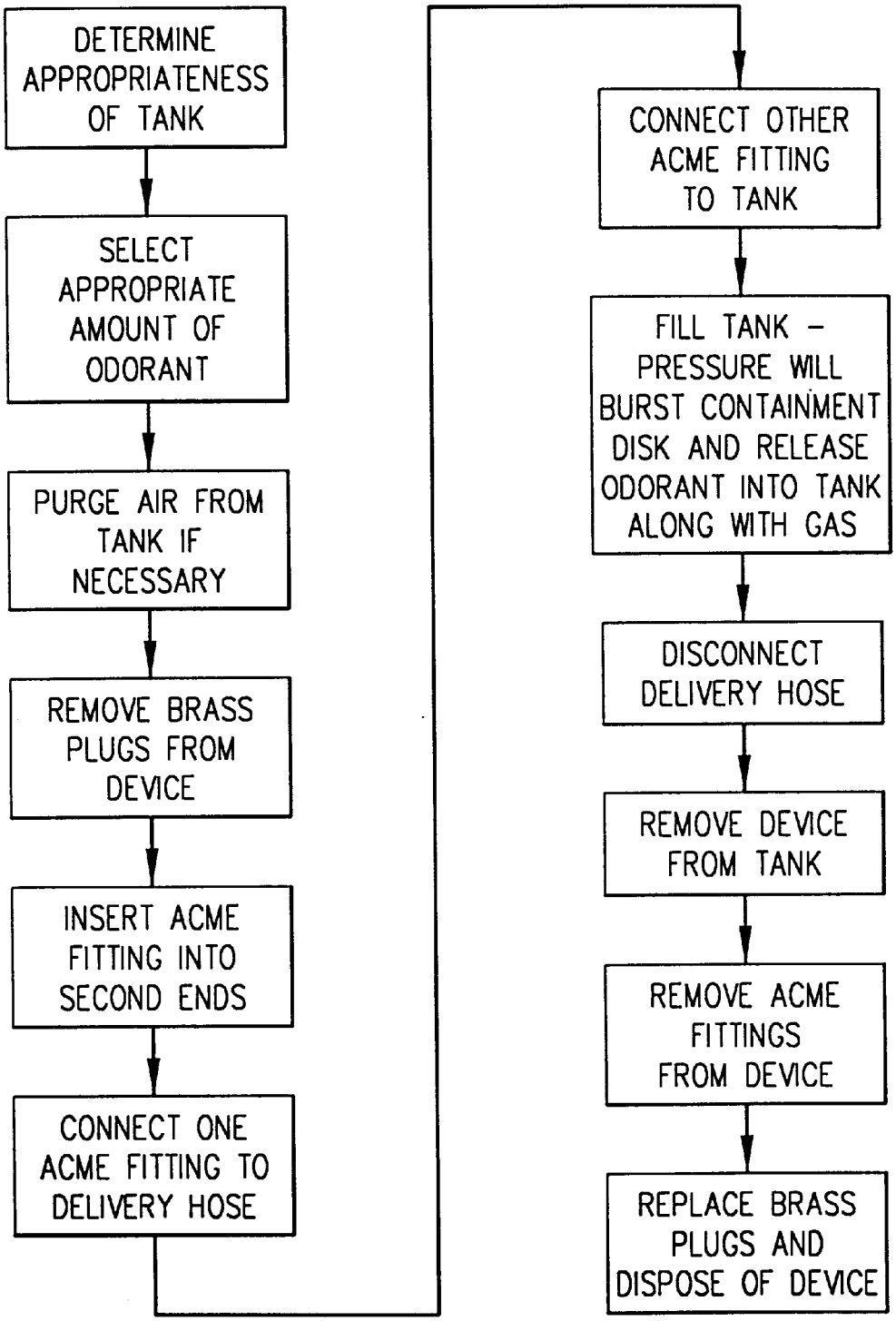
FIG. 3 is a diagram of the method for superodorizing an LP gas tank.

The invention, as disclosed in FIGS. 1–2 of the drawings, is a device 10 for the delivery of selected measured amounts of LP-gas odorant 90, specifically an ethyl mercaptan odorant, to an LP-gas tank. In a preferred embodiment, the selected size device 10 provides sufficient LP gas odorant 90 to odorize an LP-gas tank 12 having a volume capacity of between 125 and 1000 gallons of LP-gas. Specifically, the invention is an in-line LP-gas delivery device 10 comprising a hollow cylindrical aluminum container 20, most preferably a tube, having a first port 22 and a second port 32, each first port 22 and second port 32 having an external machine straight thread 24, 34. A flat, smooth circular ring 26, 36 is provided at each first port 22 and second port 32, respectively, of the hollow cylindrical aluminum container 20 indicating the respective openings 28, 38 of the hollow cylindrical aluminum container 20. The hollow cylindrical aluminum container 20 also defines an inner gas/liquid chamber 40, the entry to such inner gas/liquid chamber 40 defined by the flat, smooth circular rings 26, 36 and between the respective openings 28, 38.

The device 10 also includes two hollow cylindrical caps 50, each hollow cylindrical cap 50 having a first end 52 defining a set of internal machine straight threads 54 to engage the external machine straight threads 24, 34 of the first port 22 and second port 32 of the hollow cylindrical aluminum container 20. It is preferred that the hollow cylindrical caps 50 are a mild steel rod material having an outer surface 60 defining two parallel flat surfaces 62 for attaching a wrench. The hollow cylindrical cap 50 also includes a second end 56 having a set of internal ¾ inch female NPT threads 58, a standard in the LP-gas industry for LP-gas delivery systems. These internal ¾ inch female NPT threads 58 in the second end 56 of the hollow cylindrical cap 50 are provided to engage a ¾ inch Acme fitting attached to a delivery hose from the LP-gas delivery system used to fill the LP-gas tank and also to engage another ¾ inch Acme fitting attached to the liquid fill port of the LP-gas tank, allowing the device 10 to be placed "in-line" during tank fueling or refueling. Within the hollow cylindrical cap 50, at a location where the internal machine straight threads 54 of the first end 52 join the internal ¾ inch female NPT threads 58 in the second end 56, a smooth flat internal shoulder 66 is provided.

Compressed between the smooth flat internal shoulder 66 of each of the hollow cylindrical caps 50 and the flat, smooth circular ring 26, 36 at the first port 22 and second port 32 of hollow cylindrical aluminum container 20 is a containment disk assembly 70, comprising a containment disk 72 and two identical gasket rings 80, such containment disk assembly 70 forming an air-tight and liquid-tight seal between the containment disk assembly 70, the hollow cylindrical caps 50 and the hollow cylindrical aluminum container 20. The containment disk 72 is a thin, flat diaphragm having an outer perimeter 74, an upper surface 76 and a lower surface 78, which is capable of being ruptured by the pressure of LP-gas during the filling process. In the preferred embodiment, such pressure required to burst the containment disk 72 is 50 psi. The material comprising the containment disk 72 must be of a type which will not fracture or fragment at burst to insure that portions of the containment disk 72 do not become lodged in the LP-gas lines or system. In a preferred embodiment, the containment disk 72 is 0.005 inch Teflon® PFA.

The containment disk 72 has one of the gasket rings 80 upon the upper surface 76, such gasket ring 80 having a perimeter 82 equal to the outer perimeter 74 of the containment disk 72, and the second identical gasket ring 80 is applied upon the lower surface 78 of the containment disk 72. When the containment disk assembly 70 is placed between the smooth flat internal shoulder 66 of each of the hollow cylindrical caps 50 and the flat, smooth circular rings 26, 36 at the first end 22 and second end 32 of hollow cylindrical aluminum tube 20, the gasket rings 80 are slightly deformed by compression as the hollow cylindrical caps 50 and the hollow cylindrical aluminum container 20 are tightened together, thus forming the aforementioned air-tight and liquid-tight seal.

After the containment disk assembly 70 is applied at the first port 22 of the hollow cylindrical aluminum container 20 and the hollow cylindrical cap 50 is fastened to such first port 22, a measured amount of the LP-gas odorant 90 is placed within the inner gas/liquid chamber 40. After such measured amount of the LP-gas odorant 90 has been delivered to the inner gas/liquid chamber 40, the containment disk assembly 70 is placed upon the flat, smooth circular ring 36 of the second port 32 of the hollow cylindrical aluminum container 20 and the other hollow cylindrical cap 50 is fastened to such second port 32. The LP-gas odorant 90 is thereby contained between the two containment disk assemblies 70 within the inner gas/liquid chamber 40. It is preferred that the, LP-gas odorant 90 within the inner gas/liquid chamber 40 is delivered and contained without forced pressure or be contained at normal atmospheric pressure. As additional safety measure for transport and storage purposes, it is recommended that a brass plug 100, having an outer ¾ inch male NPT thread 102, be inserted into each of the internal ¾ inch female NPT threads 58 in the second end 56 of each of the hollow cylindrical caps 50 to prevent accidental rupture of the containment disks 72 and ensuing spillage or leakage of the LP-gas odorant 90 contained between the containment disks 72. These brass plugs 100 are removed prior to the attachment of the ¾ inch Acme fittings 18 to the second end 56 of the hollow cylindrical caps 50 between the delivery hose 14 from the LP-gas delivery system 16 used to fill the LP-gas tank 12 and the liquid fill port 13 of the LP-gas tank 12 being filled and also being "super-odorized" at the same time.

The invention is provided with a variety of amounts of LP-gas odorant 90, providing measured amounts for the variety of different size LP-gas tanks. In a preferred embodiment, the invention is provided to deliver at least three differing measured amounts, a small measured amount 90*a* suited for a 125–249 gallon LP-gas tank, a medium measured amount 90*b* suited for a 250–449 gallon LP-gas tank and a large measured amount 90*c* suited for a 450–1000 gallon LP-gas tank.

Thus, using the disclosed invention, the method for superodorizing an LP-gas tank first includes a determination that the LP-gas tank is appropriate for superodorizing due to such LP-gas tank being a new LP-gas tank, an old LP-gas tank having been open to air, a new distribution system being applied to the LP-gas tank, or notice by the user that the LP-gas has little or no detectible odorant. The user then selects the appropriate amount of LP-gas odorant 90*a*–90*c* supplied and contained within the device 10 to be delivered to the LP-gas tank. If the LP-gas tank being put into service contains air, purge the air per the standard industry practice.

Remove the brass plugs 100 from the hollow cylindrical caps 50 of the device 10 without use of a wrench or vise on the hollow cylindrical aluminum container 20. Insert a ¾ inch Acme fitting into each internal ¾ inch female NPT threads 58 in the second end 56 of each of the hollow cylindrical caps 50. Connect one of the ¾ inch Acme fittings within one of the hollow cylindrical caps 50 of the device 10 to the liquid fill port of the LP-gas tank. Next, connect the delivery hose of the LP-gas delivery system to the ¾ inch Acme fitting attached within the other hollow cylindrical cap 50. Fill the LP-gas tank in accordance with standard LP-gas delivery practice. This filling process will automatically burst the containment disks 72 at approximately 50 psi, forcing the LP-gas odorant 90 into the LP-gas tank along with the LP-gas.

After the LP-gas has been delivered to the LP-gas tank, disconnect the delivery hose from the device 10, remove the invention from the LP-gas tank, remove the ¾ inch Acme fittings from the device 10, and replace the brass plugs 100 in the used device 10. It is recommended that the device 10 either be disposed of in compliance with environmental standards or that the device 10 be returned to a dealer or distributor for proper disposal and handling.

While the invention has been particularly shown and described with reference to a preferred embodiment thereof, it will be understood by those skilled in the art that changes in form and detail may be made therein without departing from the spirit and scope of the invention.

What is claimed is:

1. A device for the delivery of a measured amount of an LP-gas odorant to an LP-gas tank, comprising:

a. a hollow container having a first port, a second port, an inner gas/liquid chamber and a means for connecting said first port and second port of the hollow container between an LP-gas delivery hose and an LP-gas tank;

b. a containment disk affixed at each first port and second port of the hollow container; and c. a measured amount of an LP-gas odorant between the containment disks within the inner gas/liquid chamber of the hollow tube, wherein the containment disks are ruptured by the force of the pressure of LP-gas after the device is installed between the LP-gas delivery hose and the LP-gas tank, while the LP-gas is delivered to the LP-gas tank, releasing the LP-gas odorant into the LP-gas tank.

2. A device for the delivery of a measured amount of an LP-gas odorant to an LP-gas tank, comprising:

a. a hollow cylindrical container having a first port with an external thread and a flat, smooth circular end, a second port having an external thread and a flat, smooth circular end and defining an inner gas/liquid chamber;

b. two hollow cylindrical caps having a first end with internal threads to engage the external thread of the first port and second port of the hollow cylindrical container, a second end having a means to engage adaptors to LP-gas fittings, and defining a smooth flat internal shoulder between the internal threads of the first end and the internal threads of the second end of each of the said hollow cylindrical caps;

c. two thin, pressure burstable, circular flat containment disks having an outer perimeter, an upper surface and a lower surface, and a means for sealing such containment disks, each of such containment disks positioned against the smooth flat internal shoulder of the hollow cylindrical cap and the flat, smooth circular end of the hollow cylindrical container, such placed containment disks and means for sealing such containment disks providing an air-tight and liquid-tight seal between the containment disk assembly, the hollow cylindrical cap and the hollow cylindrical container;

d. a measured amount of LP-gas odorant within the inner gas/liquid chamber of the hollow cylindrical container, sealed between the lower surfaces of the two containment disk assemblies, such measured amount provided depending on the capacity of the LP-gas tank to which the LP-gas odorant is to be delivered;

e. a means for plugging and sealing the second end of the hollow cylindrical caps engaging the internal threads of such second end to prevent accidental rupture or penetration of the containment disk during transport, wherein the means for plugging and sealing the second end of the hollow cylindrical caps are removed prior to the device being installed in-line during LP-gas tank refueling.

3. A device for the delivery of a measured amount of an LP-gas odorant to an LP-gas tank, comprising:

a. a hollow cylindrical container having a first port with an external thread and a flat, smooth circular end, a second port having an external thread and a flat, smooth circular end and defining an inner gas/liquid chamber;

b. two hollow cylindrical caps having a first end with internal threads to engage the external thread of the first port and second port of the hollow cylindrical container, a second end having an internal ¾ inch female NPT thread to engage standard ¾ inch Acme fitting, and defining a smooth flat internal shoulder between the internal threads of the first end and the internal threads of the second end of each of the said hollow cylindrical caps;

c. two containment disk assemblies, each containment disk assembly further comprising a thin, pressure burstable, circular flat containment disk having an outer perimeter, an upper surface and a lower surface, and two gasket rings, having a perimeter equal to that of the containment disk, one of the gasket rings located on the upper surface of the containment disk and the other gasket ring located on the lower surface of the containment disk, each of such containment disk assemblies positioned against the smooth flat internal shoulder of the hollow cylindrical cap and the flat, smooth circular end of the hollow cylindrical container, such placed containment disk assembly providing an air-tight and liquid-tight seal between the containment disk assembly, the hollow cylindrical cap and the hollow cylindrical container;

d. a measured amount of LP-gas odorant within the inner gas/liquid chamber of the hollow cylindrical container, sealed between the lower surfaces of the two containment disk assemblies, such measured amounts provided in multiple measured amounts depending on the size of the LP-gas tank to which the LP-gas odorant is to be delivered;

e. two plugs having an external ¾ male NPT thread, temporarily engaging the internal thread of the second end of the hollow cylindrical caps against the upper surface of the containment disk to prevent accidental rupture or penetration of the containment disk during transport, wherein the device may be installed in-line during LP-gas tank refueling by removing the brass plugs from the second end of the hollow cylindrical caps, installing a standard ¾ inch Acme fitting into the second end of each of the hollow cylindrical caps, connecting the delivery hose from an LP-gas delivery system to one of the ¾ inch Acme fittings and attaching the other ¾ inch Acme fitting to the LP-gas tank, a fueling the LP-gas tank, the pressure from the delivered gas rupturing the containment disk and transporting the contained LP-gas odorant into the LP-gas tank along with the LP-gas, thereby odorizing the LP-gas tank.

4. The device of claim 3, further comprising:

the hollow cylindrical container is an aluminum tube, the hollow cylindrical caps are mild steel rod and the plugs are brass.

5. The device of claim 3 of the invention, further comprising:

the containment disk is 0.005 inch Teflon PFA® which will burst without fragmentation at a pressure of 50 p.s.i.

6. The device of claim 3 of the invention, further comprising:

the internal threads of the first end of the hollow cylindrical cap and the external threads of the end of the hollow cylindrical tube are machine straight threads.

7. The device of claim 3 of the invention, further comprising:

the LP-gas odorant is ethyl mercaptan contained between the two containment disks at normal atmospheric pressure.

8. The device of claim 3, the measured amount of LP-gas odorant contained between the two containment disks provided in multiple measured amounts, further comprising:

a. a first measured amount for odorizing a 125–249 gallon LP-gas tank;

b. a second measured amount for odorizing a 250–449 gallon LP-gas tank; and c. a third measured amount for odorizing a 450–1000 gallon LP-gas tank.

9. A device for the delivery of a measured amount of an LP-gas odorant to an LP-gas tank, comprising:

a. a hollow cylindrical aluminum tube having a first port with an external machine straight thread and a flat, smooth circular end, a second port having an external machine straight thread and a flat, smooth circular end and defining an inner gas/liquid chamber;

b. two hollow cylindrical caps, made of mild steel rod, having a first end with internal machine straight threads to engage the external machine straight thread of the first port and second port of the hollow cylindrical aluminum tube, a second end having an internal ¾ inch female NPT thread to engage a standard ¾ inch Acme fitting, and defining a smooth flat internal shoulder between the internal threads of the first end and the internal threads of the second end of each of the said hollow cylindrical caps;

c. two containment disk assemblies, each containment disk assembly further comprising a thin, pressure burstable, circular flat 0.005 inch Teflon PFA® containment disk which will burst without fragmentation at a pressure of 50 p.s.i., having an outer perimeter, an upper surface and a lower surface, and two gasket rings, having a perimeter equal to that of the containment disk, one of the gasket rings located on the upper surface of the containment disk and the other gasket ring located on the lower surface of the containment disk, each of such containment disk assemblies positioned against the smooth flat internal shoulder of the hollow cylindrical cap and the flat, smooth circular end of the hollow cylindrical aluminum tube, such placed containment disk assembly providing an air-tight and liquid-tight seal between the containment disk assembly, the hollow cylindrical cap and the hollow cylindrical aluminum tube;

d. a measured amount of ethyl mercaptan LP-gas odorant at normal atmospheric pressure within the inner gas/liquid chamber of the hollow cylindrical aluminum tube, sealed between the lower surfaces of the two containment disk assemblies, such measured amounts of ethyl mercaptan LP-gas odorant provided in multiple measured amounts depending on the size of the LP-gas tank to which the LP-gas odorant is to be delivered;

e. two brass plugs having an external ¾ male NPT thread, temporarily engaging the internal thread of the second end of the hollow cylindrical caps against the upper surface of the containment disk to prevent accidental rupture or penetration of the containment disk during transport, wherein the device may be installed in-line during LP-gas tank refueling by removing the brass plugs from the second end of the hollow cylindrical caps, installing a standard ¾ inch Acme fitting into the second end of each of the hollow cylindrical caps, connecting the delivery hose from an LP-gas delivery system to one of the ¾ inch Acme fittings and attaching the other ¾ inch Acme fitting to the LP-gas tank, a fueling the LP-gas tank, the pressure from the delivered gas rupturing the containment disk and transporting the contained LP-gas odorant into the LP-gas tank along with the LP-gas, thereby odorizing the LP-gas tank.

10. A method for superodorizing an LP-gas tank using the device of claim 2, comprising:

a. determining the appropriateness of the LP-gas tank to be superodorized;

b. selecting the appropriate measured amount of LP-gas odorant contained within the device to be delivered to the suitable LP-gas tank;

c. purging the suitable LP-gas tank of air, if any, per industry standard practice;

d. removing the brass plugs from the hollow cylindrical caps of the invention;

e. inserting a standard Acme fitting into the second end of each of the hollow cylindrical caps;

f. connecting one of the inserted standard Acme fittings to the delivery hose of the LP-gas delivery system;

g. connecting the other inserted standard Acme fitting to the LP-gas tank;

h. filling the LP-gas tank in accordance with standard LP-gas delivery practice, such filling causing a bursting of the containment disks forcing the contained LP-gas odorant into the tank along with the LP-gas;

i. disconnecting the delivery hose from the invention;

j. removing the invention from the LP-gas tank;

k. removing the Acme fittings from the invention;

l. replacing the brass plugs into the hollow cylindrical caps; and m. disposing of the remaining invention in compliance with environmental standards.

* * * * *